US008528896B2

(12) United States Patent
Miwa

(10) Patent No.: US 8,528,896 B2
(45) Date of Patent: Sep. 10, 2013

(54) IMAGE FORMING APPARATUS

(75) Inventor: Atsushi Miwa, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 171 days.

(21) Appl. No.: 13/242,265

(22) Filed: Sep. 23, 2011

(65) Prior Publication Data

US 2012/0107033 A1 May 3, 2012

(30) Foreign Application Priority Data

Oct. 29, 2010 (JP) ..... 2010-244465

(51) Int. Cl.
*B65H 1/00* (2006.01)

(52) U.S. Cl.
USPC ..... 271/145; 271/162

(58) Field of Classification Search
USPC ..... 271/145, 162; 206/449
See application file for complete search history.

(56) References Cited

U.S. PATENT DOCUMENTS

| | | | | |
|---|---|---|---|---|
| 4,540,169 | A * | 9/1985 | Levinson | 271/127 |
| 5,292,116 | A * | 3/1994 | Inoue et al. | 271/157 |
| 5,823,647 | A * | 10/1998 | Miyoshi | 312/333 |
| 6,722,647 | B2 * | 4/2004 | Kato et al. | 271/3.03 |
| 7,216,864 | B2 * | 5/2007 | Yoshihara | 271/145 |
| 7,591,464 | B2 * | 9/2009 | Mizobe | 271/160 |
| 7,819,398 | B2 * | 10/2010 | Fukumasu | 271/164 |
| 7,862,034 | B2 * | 1/2011 | Kobayashi | 271/145 |
| 8,210,524 | B2 * | 7/2012 | Uchida | 271/164 |
| 2010/0044956 | A1 * | 2/2010 | Ko | 271/162 |

FOREIGN PATENT DOCUMENTS

| | | | |
|---|---|---|---|
| JP | SHO 55-70642 | A | 5/1980 |
| JP | SHO 59-91235 | A | 6/1984 |
| JP | SHO 59-91235 | U | 6/1984 |
| JP | HEI 8-231060 | A | 9/1996 |
| JP | 2003-107822 | A | 4/2003 |

* cited by examiner

*Primary Examiner* — Kaitlin Joerger
(74) *Attorney, Agent, or Firm* — Scully, Scott, Murphy & Presser, PC

(57) ABSTRACT

An image forming apparatus having an image forming unit, a pair of frames, and a sheet cassette, is provided. The sheet cassette has a pair of lateral walls, a first engagement portion, and a first joint portion. Space enclosed by the first engagement portion, the first joint portion, and an outer surface of one of the lateral walls is exposed toward an installation side, from which the sheet cassette is installed in the image forming apparatus. The pair of frames has a second engagement portion and a second joint portion. Space enclosed by the second engagement portion, the second joint portion, and an inner surface of the one of the frames is exposed toward a side opposite from the installation side. When the sheet cassette is in an operable position, the first engagement portion is placed in an engagement position to be engaged with the second engagement portion.

4 Claims, 10 Drawing Sheets

IMAGE FORMING APPARATUS

CROSS REFERENCE TO RELATED APPLICATION

This application claims priority from Japanese Patent Application No. 2010-244465, filed on Oct. 29, 2010, the entire subject matter of which is incorporated herein by reference.

BACKGROUND

1. Technical Field

An aspect of the present invention relates to an image forming apparatus having a pair of frames to hold an image forming unit therein.

2. Related Art

An image forming apparatus containing an image forming unit to form an image on a recording sheet and a pair of frames to hold the image forming unit in there-between in an exterior covering is known. Inside the covering, the frames may be fixed to each other by purpose-made top and bottom joint members, which are in shapes of plates to connect top portions and bottom portions of the frames respectively.

SUMMARY

When the purpose-made joint members in the shapes of plates are attached to large areas of the top portions and the bottom portions of the frames, cost for manufacturing the image forming apparatus may increase. In order to reduce manufacturing cost, sizes of the plates being the joint members may be reduced, and the joint members may partially be attached to smaller areas of the top portions and the bottom portions of the frames and may partially connect the frames. In other words, the frames may be fixed to each other by the joint members at smaller areas in the top portions and the bottom portions. Therefore, when the sizes of the joint members are reduced, the frames may be deformed to be separated apart from each other at the non-attached areas when force to widen stretch the frames 21 outward is applied, and rigidity of the frames may be undesirably decreased.

In view of the above difficulties, the present invention is advantageous in that an image forming apparatus having a pair of frames, which are restricted from being separated apart from each other even without the purpose-made joint members, is provided.

According to an aspect of the present invention, an image forming apparatus is provided. The image forming apparatus includes an image forming unit, which is configured to form an image on a recording sheet having a width and a length, a pair of frames, which are arranged to face each other and hold the image forming unit interposed in there-between, and a sheet cassette, which is configured to store the recording sheet therein and to be movable between an operable position, in which the sheet cassette is settled in between the pair of frames, and a removed position, which is out of the operable position. The sheet cassette is formed to have a pair of lateral walls on widthwise sides of the sheet cassette along a direction of width of the recording sheet, a first engagement portion, which is arranged on a widthwise outer side of one of the lateral walls with clearance being maintained from an outer surface of the one of the lateral walls, and a first joint portion, which connects the first engagement portion and the one of the lateral walls. Space enclosed by the first engagement portion, the first joint portion, and the outer surface of the one of the lateral walls is exposed toward an installation side, from which the sheet cassette is installed in the image forming apparatus. The pair of frames is formed to have a second engagement portion, which is arranged on an inner surface of one of the frames along the direction of width of the recording sheet, and a second joint portion, which connects the second engagement portion and the inner surface of the one of the frames. Space enclosed by the second engagement portion, the second joint portion, and the inner surface of the one of the frames is exposed toward a side opposite from the installation side. When the sheet cassette is in the operable position, the first engagement portion is placed in an engagement position on widthwise outer side with respect to the second engagement portion to be engaged with the second engagement portion.

BRIEF DESCRIPTION OF THE ACCOMPANYING DRAWINGS

Figure 3:
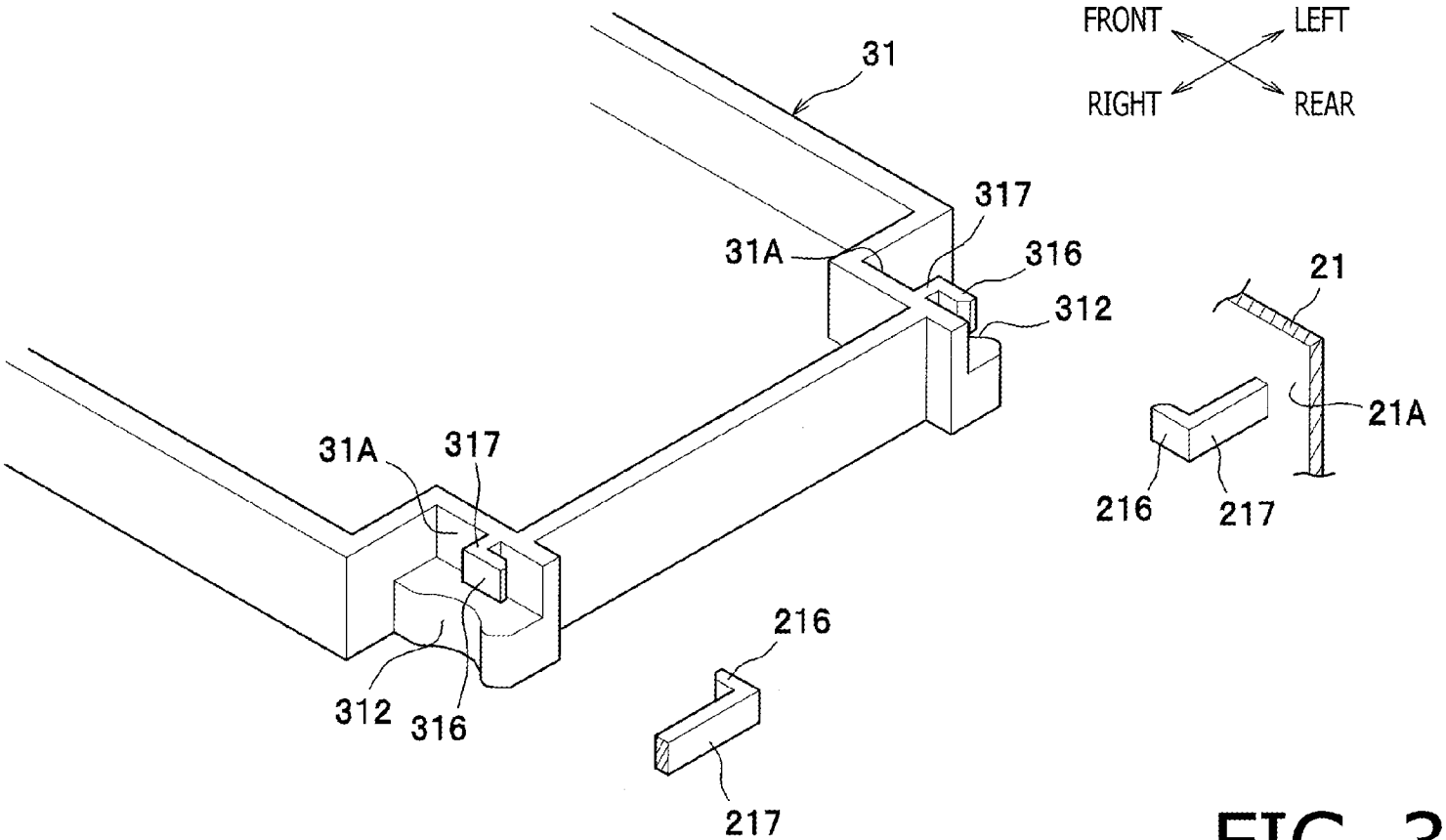

FIG. 3 a perspective view of first engagement claws and a part of a sheet-feed tray with second engagement claws in the laser printer according to the embodiment of the present invention.

Figure 4:
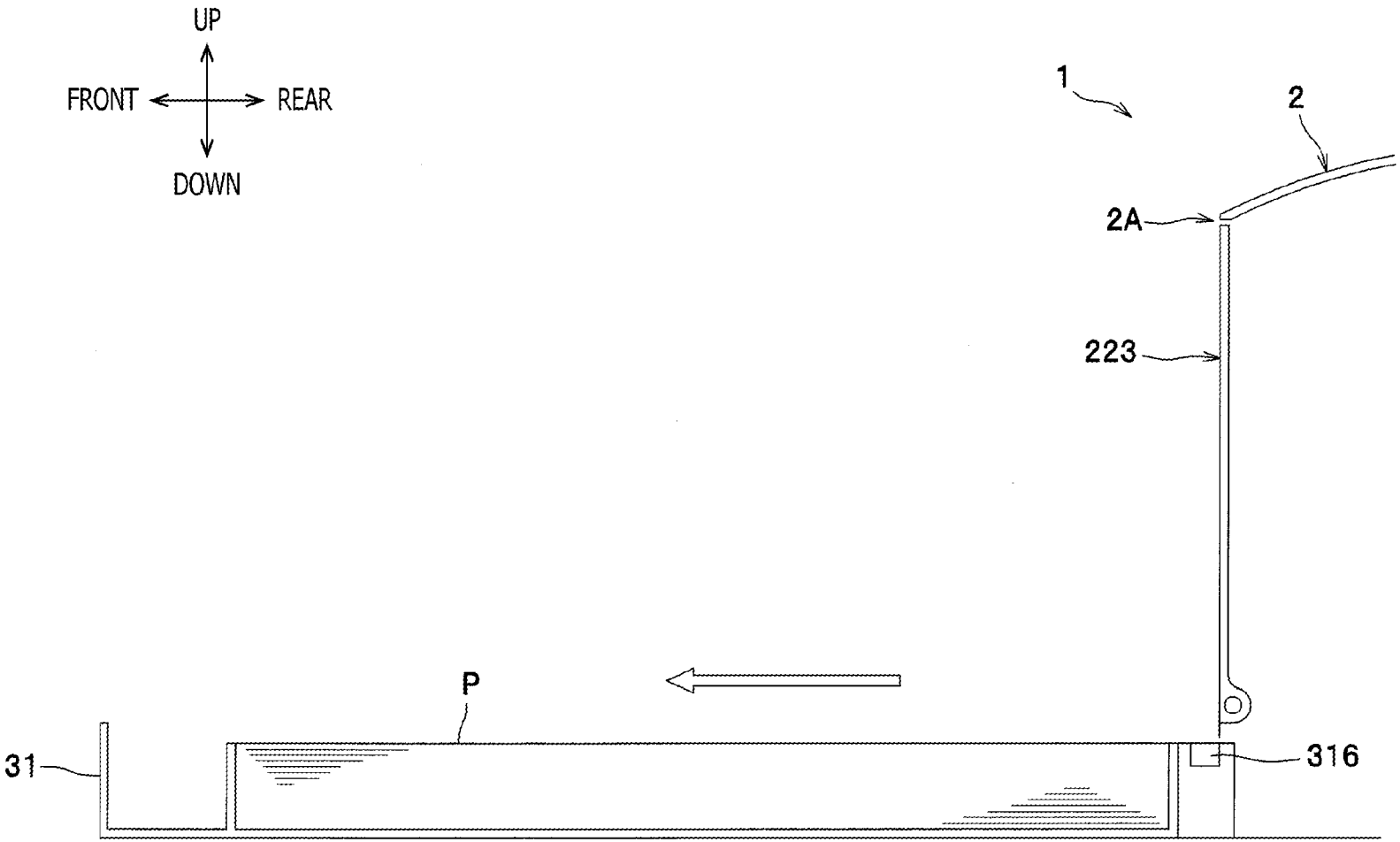

FIG. 4 is a diagram to illustrate the sheet-feed tray in a removed position in the laser printer according to the embodiment of the present invention.

Figure 5:
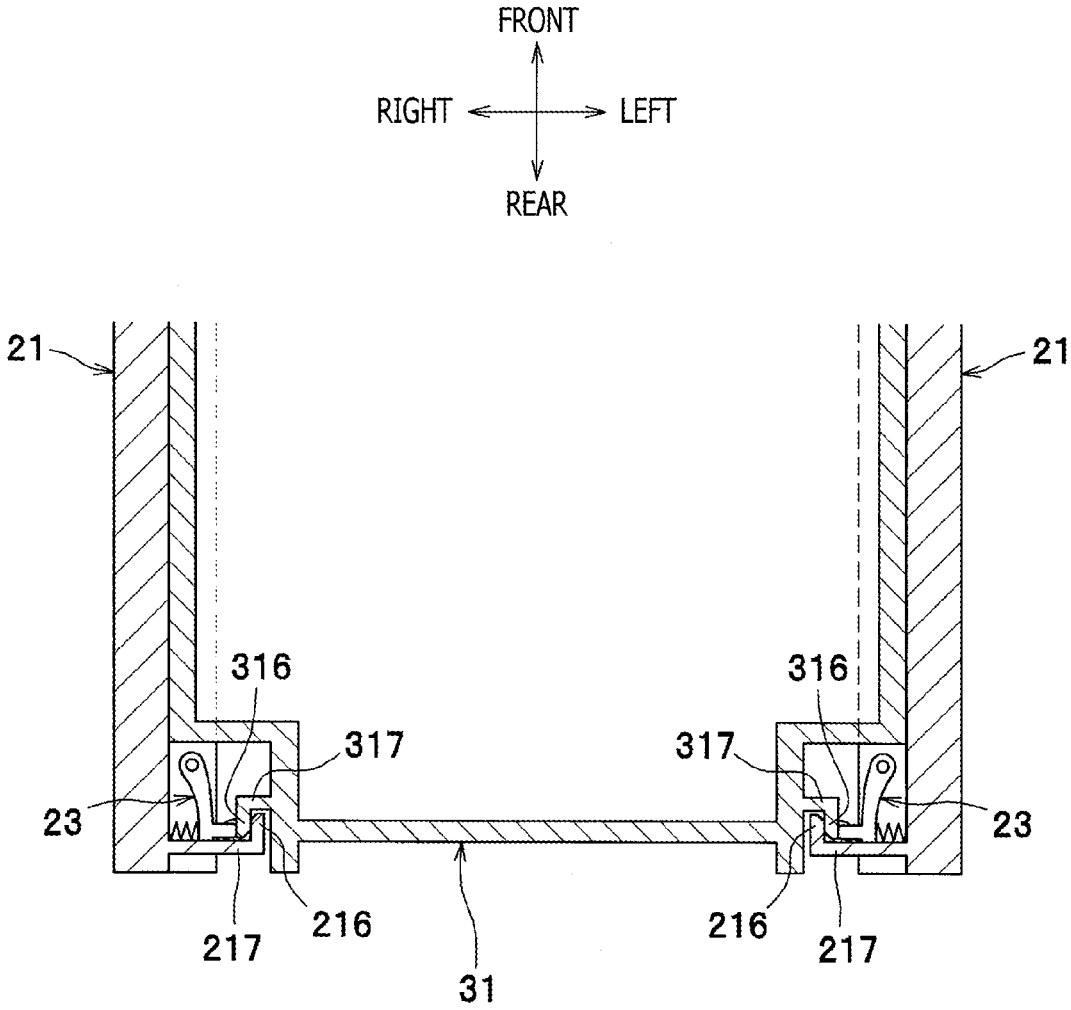

FIG. 5 is a horizontally-sectioned view of the first engagement claws formed in the frames and the second engagement claws formed in the sheet-feed tray in the laser printer according to the embodiment of the present invention.

Figure 6:
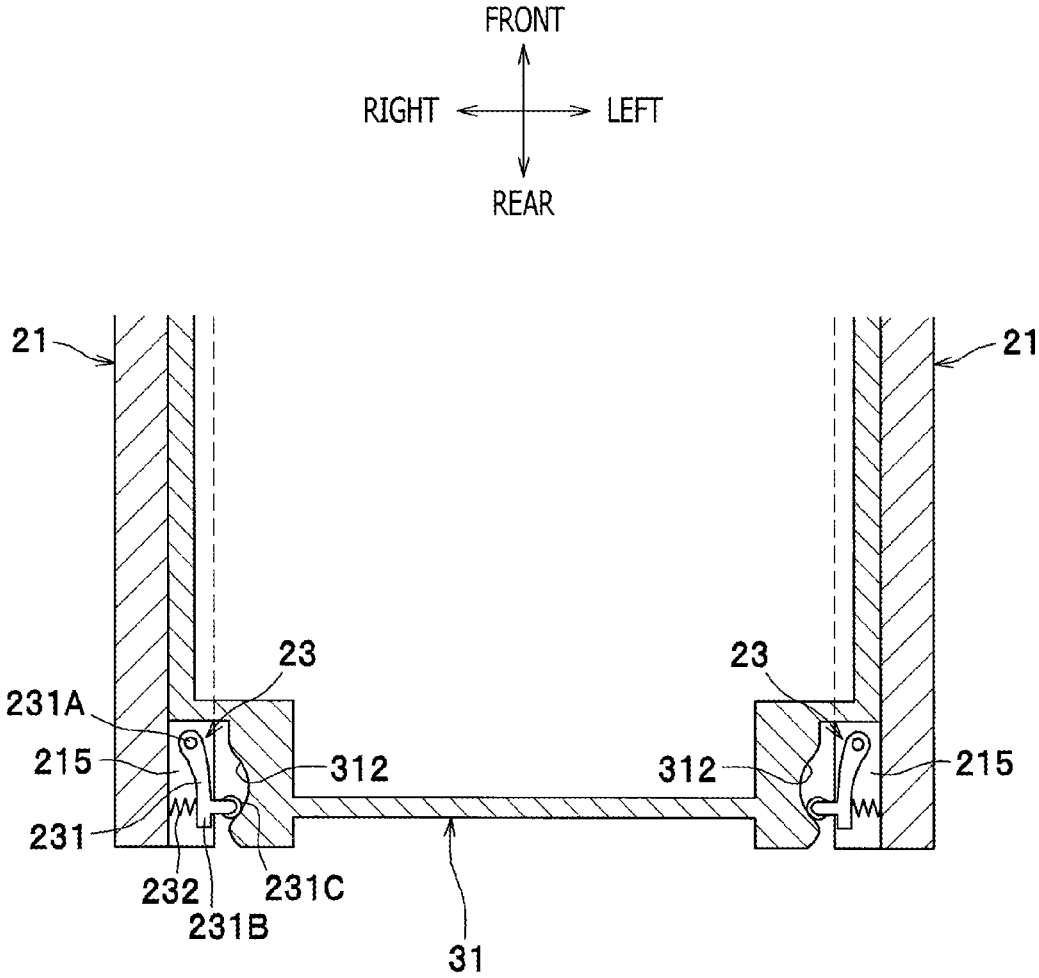

FIG. 6 is a horizontally-sectioned view of first locks and surroundings in the laser printer according to the embodiment of the present invention.

Figure 7:
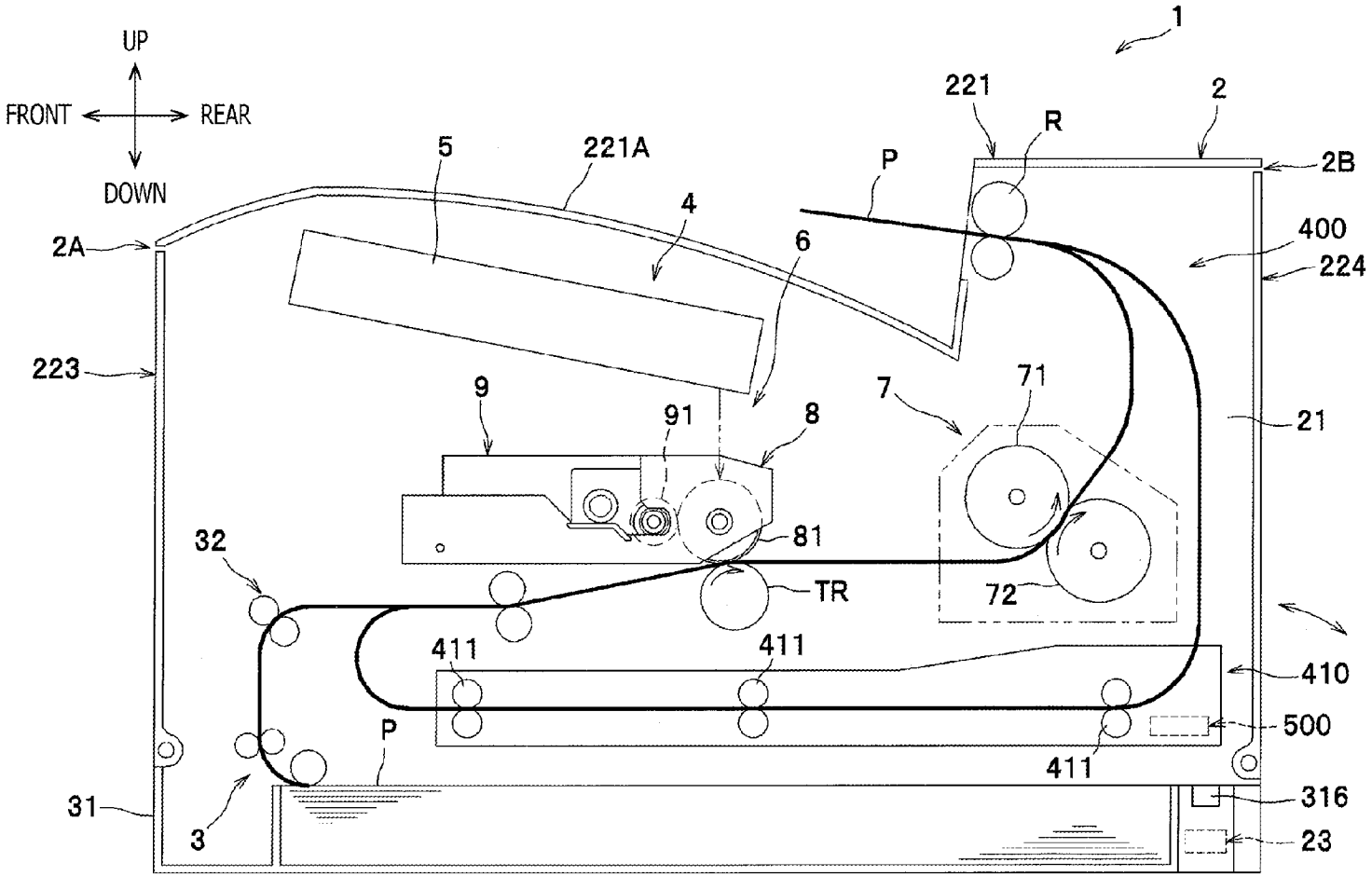

FIG. 7 is a cross-sectional side view of a laser printer with a return-conveying unit according to the embodiment of the present invention.

Figure 8:
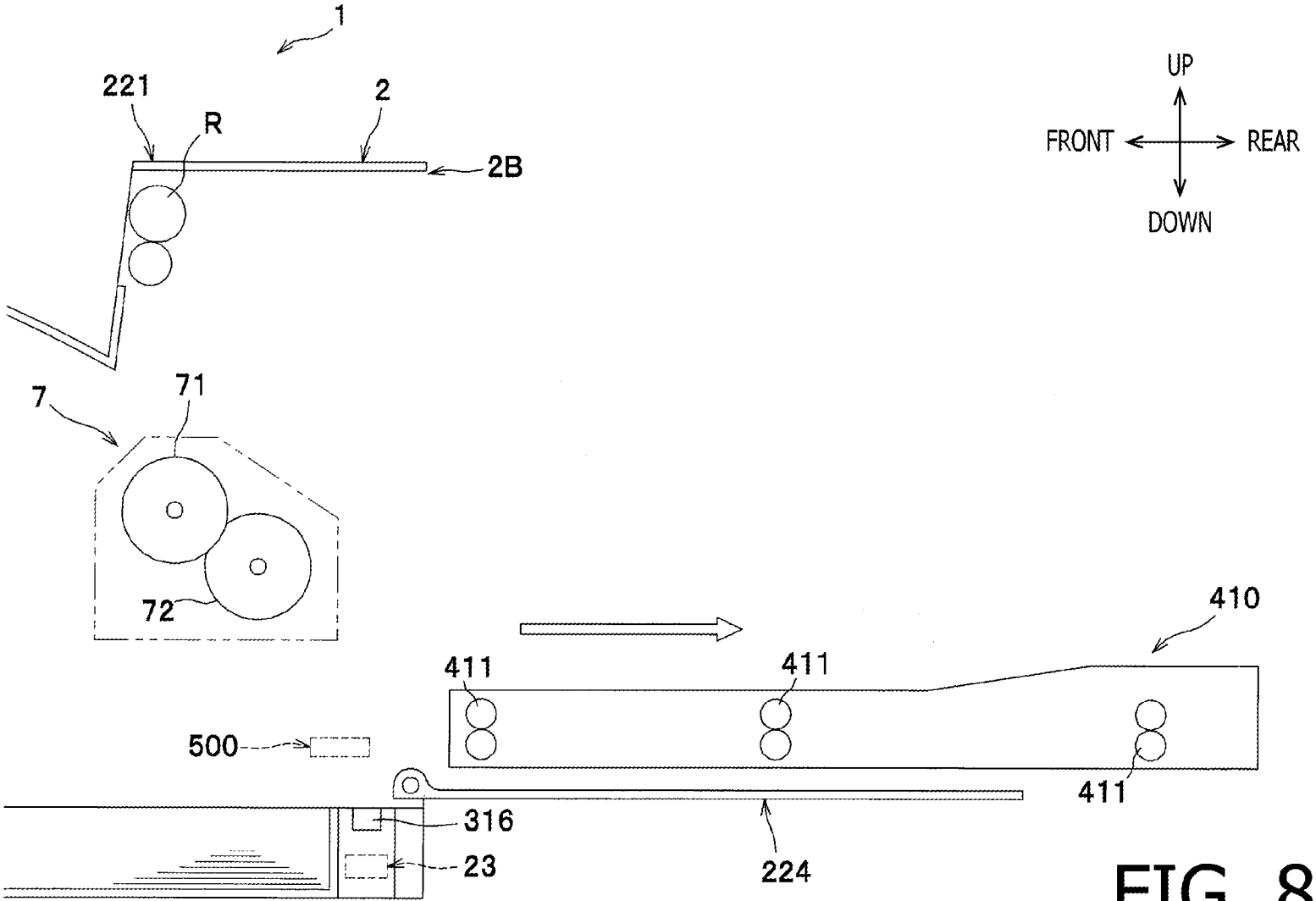

FIG. 8 is a diagram to illustrate the return-conveying unit removed out of the laser printer according to the embodiment of the present invention.

Figure 9:
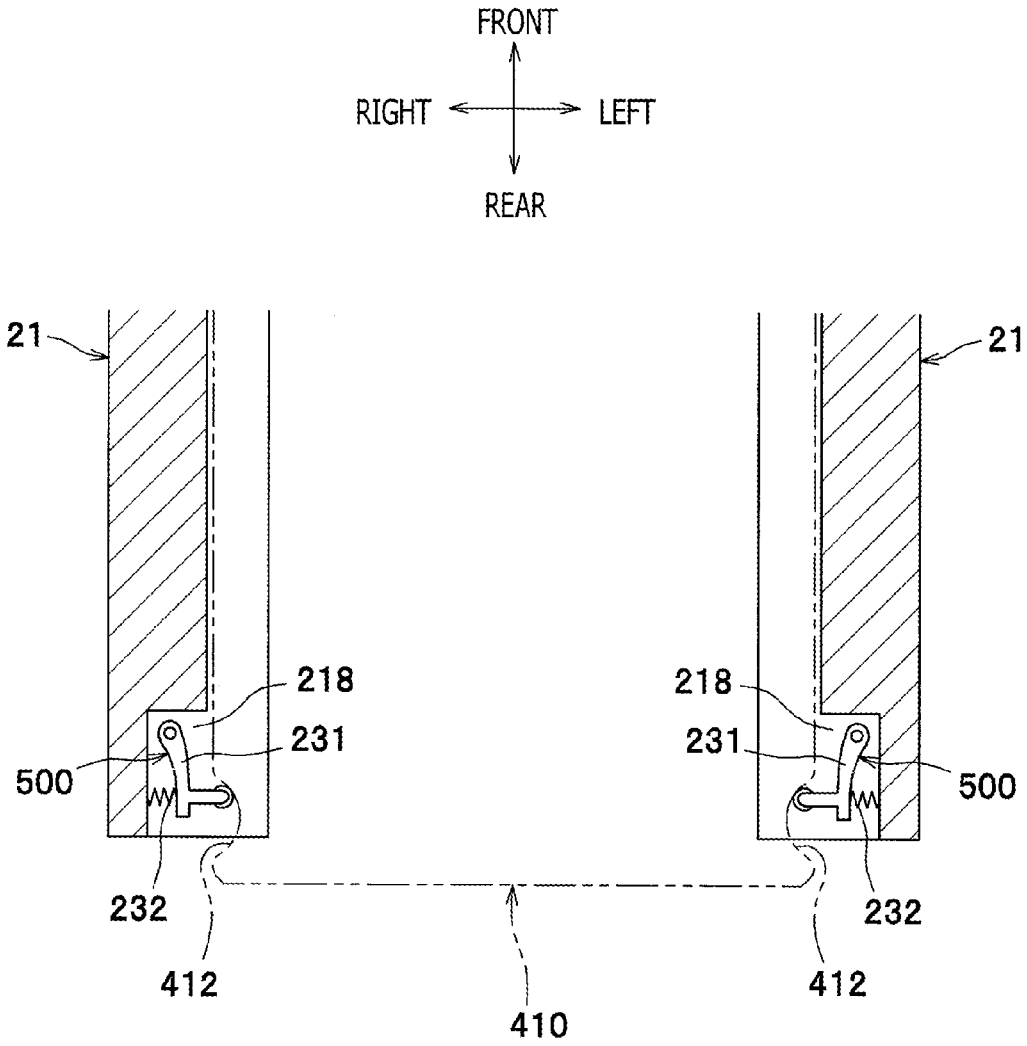

FIG. 9 is a horizontally-sectioned view of second locks and surroundings in the laser printer according to the embodiment of the present invention.

Figure 10:
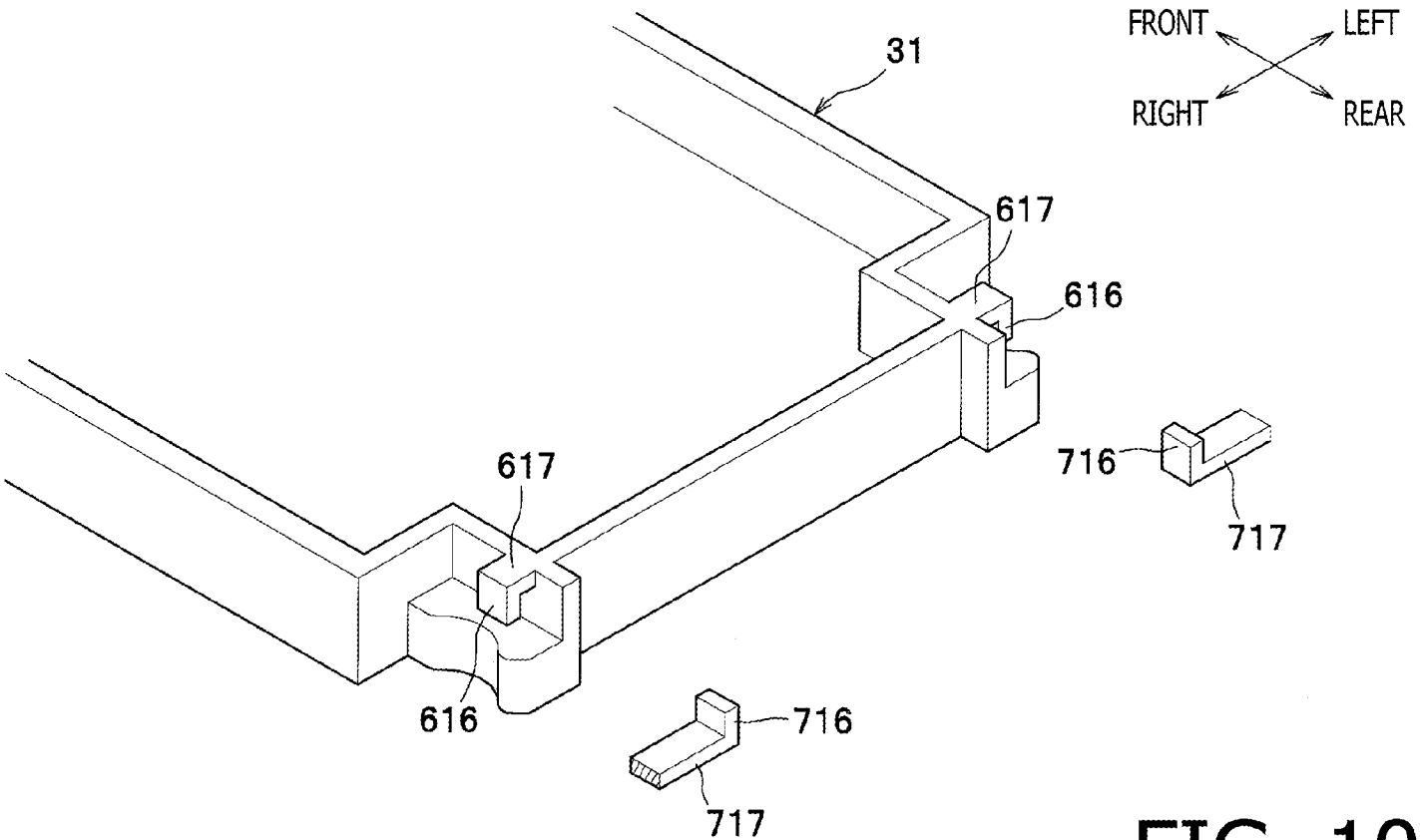

FIG. 10 is a perspective view of first engagement claws and a part of a sheet-feed tray with second engagement claws in a different example according to the embodiment of the present invention.

DETAILED DESCRIPTION

Figure 1:
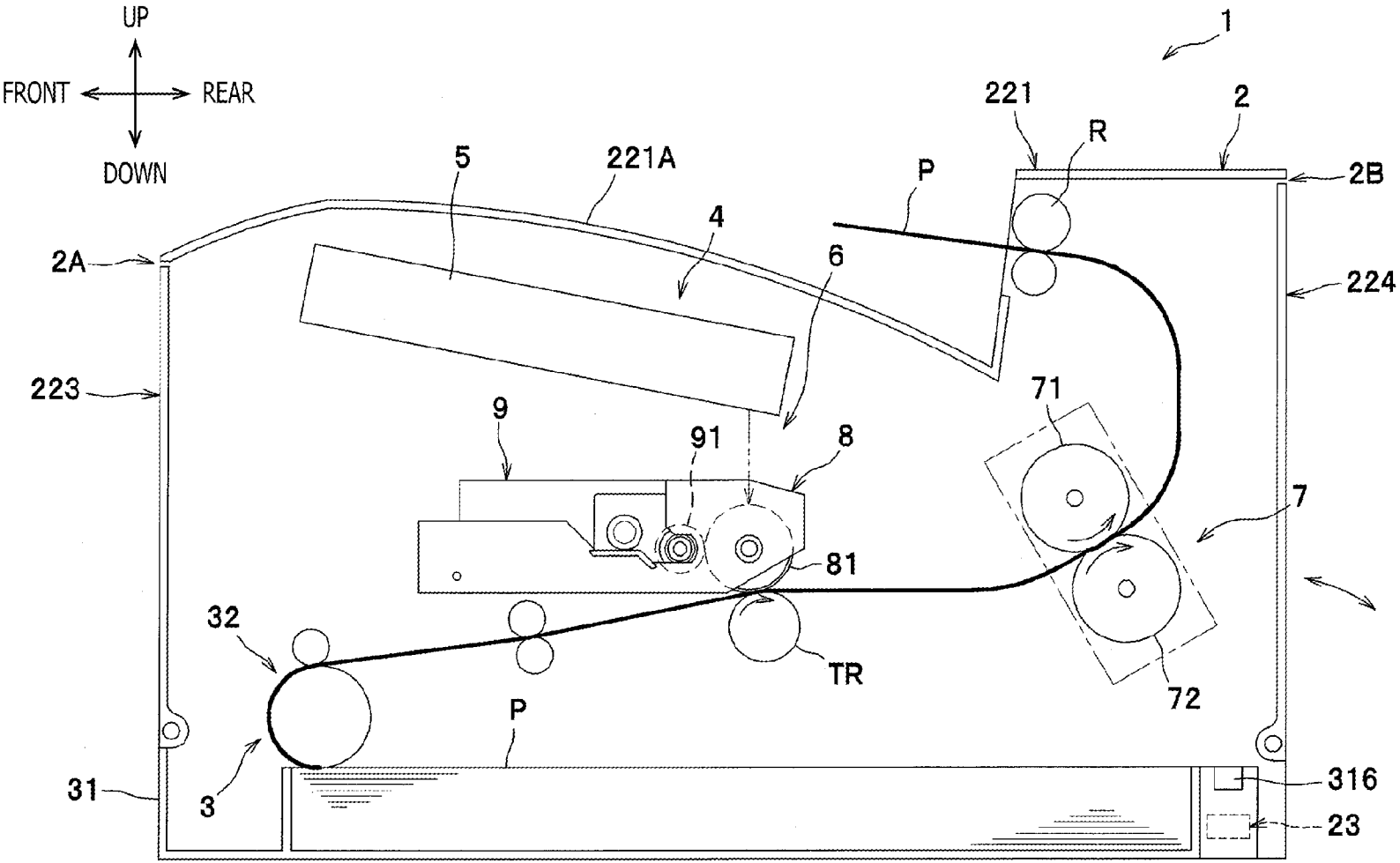
FIG. 1 is a cross-sectional side view of a laser printer according to an embodiment of the present invention.

Hereinafter, an embodiment according to an aspect of the present invention will be described with reference to the accompanying drawings. In the following description, firstly, an overall configuration of a laser printer 1 being an image forming apparatus will be described. Secondly, more specific configuration of the laser printer 1 will be described in detail. In the present embodiment, directions concerning the laser printer 1 will be referred to based on the orientation of the laser printer 1 shown in FIG. 1. Therefore, for example, a viewer's left-hand side appearing in FIG. 1 is referred to as a front side of the laser printer 1, and a right-hand side in FIG. 1 opposite from the front side is referred to as rear. A side which corresponds to the viewer's nearer side is referred to as right, and an opposite side from the right, which corresponds to the viewer's further side, is referred to as left. The up-down direction in FIG. 1 corresponds to a vertical direction of the laser printer 1. The right-left direction may be referred to as a widthwise direction, and the front-rear direction may be referred to as a direction of depth. Further, directions of the drawings in FIGS. 2-10 are similarly based on the orientation of the laser printer 1 as defined above and correspond to those with respect to the laser printer 1 shown in FIG. 1 even when the laser printer 1 and components thereof are viewed from different angles.

Overall Configuration of Laser Printer

The laser printer 1 includes an image forming unit 4 and a feeder unit 3. The image forming unit 4 forms an image on a sheet P of paper being a recording medium. The feeder unit 3 feeds the sheet P to the image forming unit 4.

The feeder unit 4 includes sheet-feed tray 31 being a sheet cassette, which stores the sheet P therein and is detachably attached to a main body 2 of the laser printer 1, and a feeder system 32, which conveys the sheet P from the sheet-feed tray 31 along a sheet path to the image forming unit 4. The sheet P is set in the sheet-feed tray 31 with its width aligned to the widthwise direction of the laser printer 1 and with its length aligned orthogonally to the widthwise direction.

The image forming unit 4 includes a scanner unit 5, a processing cartridge 6, a transfer roller TR, and a fixing unit 7.

The scanner unit 5 is arranged in an upper section in the main body 2 and includes a laser emitter, polygon mirrors, lenses, and reflection mirrors, which are not shown. The scanner unit 5 emits laser beam to scan a surface of a photosensitive drum 81, which will be described in detail below.

The processing cartridge 6 is detachably attached to the main body 2. The processing cartridge 6 includes a drum cartridge 8 with a photosensitive drum 81, and a developer cartridge 9 including a developer roller 91 and toner.

In the processing cartridge 6, a peripheral surface of the photosensitive drum 81 being rotated is evenly charged by a charger (not shown) and exposed to the laser beam selectively emitted from the scanner unit 5. Thus, potential of the exposed areas is lowered, and a latent image is formed in the lower-potential areas on the surface of the photosensitive drum 81.

Meanwhile, the developer roller 91 being rotated carries the toner contained in the developer cartridge 9 and supplies the toner to the latent image on the surface of the photosensitive drum 81. When the toner adheres to the surface of the photosensitive drum 81, a toner image is formed on the surface of the photosensitive drum 81. When the sheet P is carried in a position between the photosensitive drum 81 and the transfer roller TR, the toner image on the photosensitive drum 81 is transferred onto the surface of the sheet P. Thus, the image is formed on the surface of the sheet P.

The fixing unit 7 includes a heat roller 71 and a pressure roller 72. The pressure roller 82 is arranged in an opposite position from the heat roller 71 to be pressed against the heat roller 71. When the sheet P with the toner image formed thereon is carried in a position between the heat roller 71 and the pressure roller 72, the toner image is fixed thereto by the heat and the pressure.

The sheet P with the thermally-fixed image is conveyed further by a discharge roller R, which is arranged on a downstream side of the fixing unit 7 along the sheet path, to be ejected out of the main body 2.

Configuration of the Main Body

Figure 2:
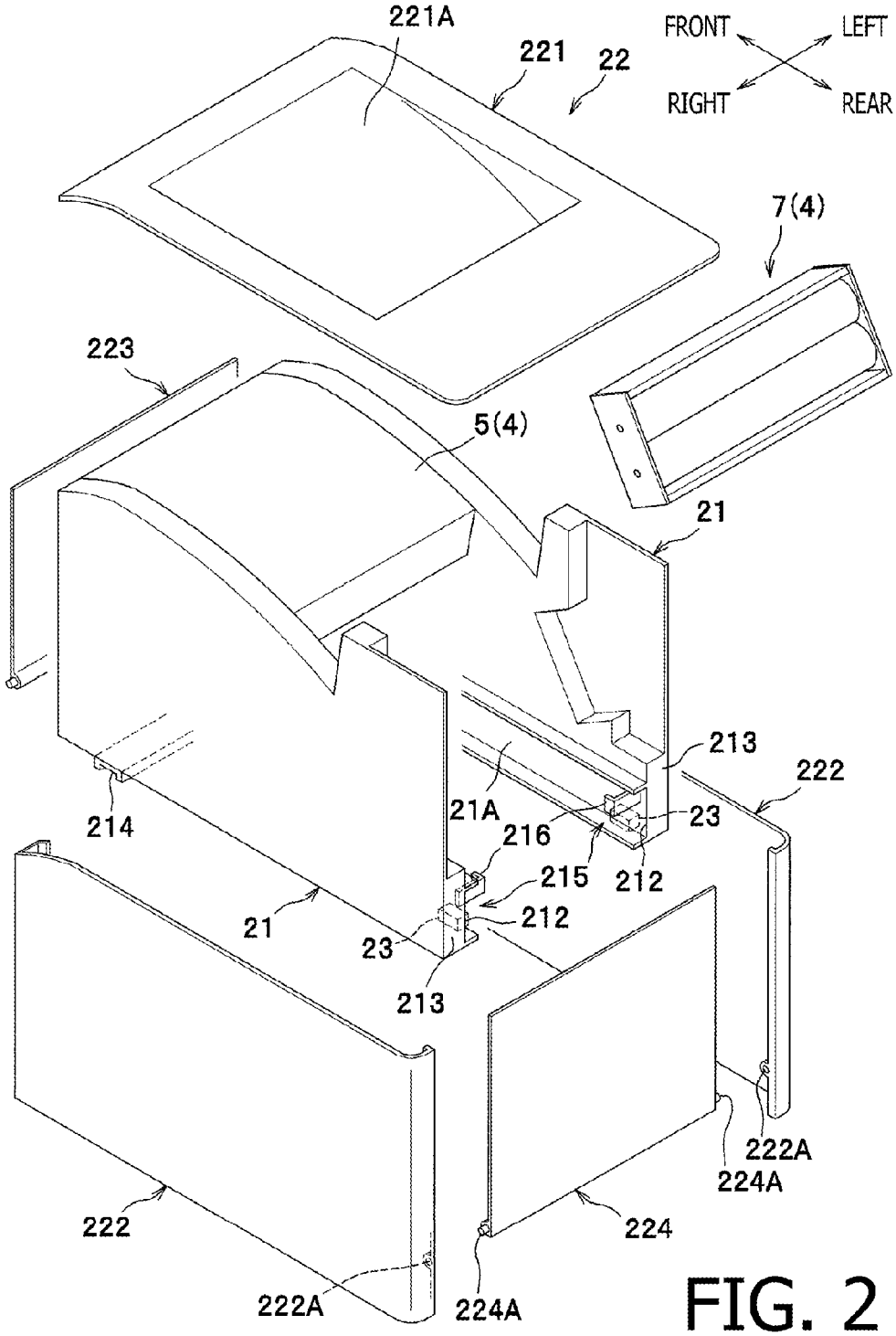
FIG. 2 is an exploded view of exterior coverings and a pair of frames in the laser printer according to the embodiment of the present invention.

Configuration of components in the main body 2 will be described below in detail. As shown in FIG. 2, the main body 2 includes a pair of frames 21, which are arranged to oppose to each other to hold the image forming unit 4 interposed there-between, and exterior coverings 22, which cover the image forming unit 4 and the frames 21.

The exterior coverings 22 are made of resin and includes a top panel 221, which is arranged on top of the pair of frames 21, a side panels 222, which are arranged on right and left outer sides of the frames 21, a front cover 223, which is arranged on an outer front position of the frames 21, and a rear cover 224, which is arranged on an outer rear position of the frames 21.

The top panel 221 is formed to have a discharge tray 221A, in which the sheet P ejected by the discharge roller R (see FIG. 1) is settled. The top panel 221 is attached to top edges of the frames 21 via adhesive agent.

The side panels 222 are fixed to a right-side and left-side outer surfaces of the frames 21. Each of the side panels 222 is formed to have a front bearing (not shown), which rotatably supports the front cover 223, and a rear bearing 222A, which rotatably supports the rear cover 224.

The front cover 223 is formed to have a shape and a size to cover a front opening 2A (see FIG. 1) of the main body 2. The front opening 2A is defined by a front edge of the top panel 221, front edges of the side panels 222, and an upper edge of a front surface of the sheet-feed tray 31. The front cover 223 is rotatably supported by the side panels 222 via the front bearings at a lower edge thereof to expose and cover the front opening 2A. When the front cover 223 is in an open position (not shown) to expose the front opening 2A, the processing cartridge 6 can be installed in or removed from the main body 2 through the front opening 2A.

The rear cover 224 is formed to have a shape and a size to cover a rear opening 2B (see FIG. 1) of the main body 2. The rear opening 2B is defined by a rear edge of the top panel 221 and rear edges of the side panels 222. The rear cover 224 is rotatably supported by the side panels 222 via the rear bearings 222A at a lower edge thereof to expose and cover the rear opening 2B. When the rear cover 223 is in an open position (not shown) to expose the rear opening 2B, the sheet P jammed in the sheet path can be removed therefrom through the rear opening 2B.

The frames 221 may be made of metal or resin and are attached to each other at top portions thereof via the scanner unit 5. Therefore, the frames 221 are restricted by the scanner unit 5 from being moved in the widthwise (right-left) direction and from being separated from each other at the top portions. It is to be noted that the fixing unit 7 or the processing cartridge 6 (not shown in FIG. 2) does not necessarily restrict the frames 21 from being moved in the widthwise direction. Rather, in order to correctly hold the thermally distensible fixing unit 7, the fixing unit 7 is supported by the frames 21 via pinholes (not shown), which are elongated in the widthwise direction, and pins (not shown) to be inserted in the pinholes.

On lower edges of the frames 21 and in vicinity of the front edges of the frames 21, a joint beam 214 to connect the side frames 21 at lower front sections thereof is provided. Therefore, the side frames 21 are restricted from being separated apart from each other in the widthwise direction by the joint beam 214 at the lower front sections.

Meanwhile, at the lower side and in the vicinity of the rear edges, the frames 21 are attached to each other via first engagement claws 316 (see FIG. 3) in the sheet-feed tray 31 and are restricted from being moved a from each other in the widthwise direction. The attachment of the frames 21 via the sheet-feed tray 31 will be described later in detail.

On inner surfaces of the frames 21, in lower positions, rails 215 are formed. The rails 215 have cross-sectional shapes of "brackets" and extend in the rear-front direction along the inner surfaces of the frames 21 to slidably guide the sheet-feed tray 31 along the direction of depth. Therefore, the sheet-feed tray 31 is movable between an operable position (see FIG. 1), in which the sheet-feed tray 31 is settled in the position between the frames 21, and a removed position, which is out of the operable position (e.g., FIG. 4) to allow the sheet P to be removed from the sheet-feed tray 31.

Inside each of the rails 215, a second engagement claw 216 and a first lock 23 are arranged. The second engagement claw 216 is formed to be engageable with a first engagement claw 316 (see FIG. 3) of the sheet-feed tray 31, and the first lock 23 is arranged to place the sheet-feed tray 31 in the operable position. The first engagement claw 316 of the sheet-feed tray 31 will be described later in detail. It is to be noted, in the drawings of perspective views such as FIG. 2 (cf. FIG. 6), that the first locks 23 are drawn in simplified box-shaped figures for convenience.

The second engagement claws 216 are arranged along the widthwise direction of the laser printer 1 and extend in parallel with the frames 21 in inner positions with respect to the frames 21 (see FIG. 3). Each of the second engagement claws 216 is arranged to maintain clearance from an inner surface 21A of the frame 21 and connected with the inner surface 21A via a second joint piece 217 at a rear end thereof. Therefore, whilst the second joint piece 217 connects the second engagement claw 216 and the inner surface 21A, space enclosed by the second engagement claw 216, the second joint piece 217, and the inner surface 21A is exposed toward front, i.e., toward a side opposite from an installation side. The installation side refers to a side, from which the sheet-feed tray 31 is installed (e.g., the rear side).

Meanwhile, the sheet-feed tray 31 is formed to be smaller in width at a rear end section, and inner-side lateral walls 31A are formed in the smaller-width section along the widthwise direction. Further, the sheet-feed tray 31 is formed to have first engagement claws 316 and first joint pieces 317 (see FIG. 3). The inner-side lateral walls 31A are formed on right and left sides of the sheet-feed tray 31 to face each other and to extend in parallel with the direction of depth of the sheet-feed tray 31. The first engagement claws 316 are arranged to extend in parallel with the inner-side lateral walls 31A in outer positions with respect to the inner-side lateral walls 31A. Each of the first engagement claws 316 is arranged to maintain clearance from an outer surface of the inner-side lateral wall 31A and connected with the inner-side lateral wall 31A via the first joint piece 317 at a front end thereof. Therefore, whilst the first joint piece 317 connects the first engagement claw 316 and the inner-side lateral wall 31A, space enclosed by the first engagement claw 316, the first joint piece 317, and the inner-side lateral wall 31A is exposed toward rear, i.e., toward the installation side, from which the sheet-feed tray 31 is installed.

When the sheet-feed tray 31 is installed in the operable position (see FIG. 5), the first engagement claws 316 are placed in engagement positions on outer sides with respect to the second engagement claws 216 to be engaged with the second engagement claws 216. The engagement restricts lower rear portions of the frames 21 from being separated apart from each other in the widthwise direction.

It is to be noted that rear edges of the first engagement claws 316 are beveled inwardly, and front edges of the second engagement claws 216 are beveled outwardly in order to lead the first engagement claws 316 smoothly to the outer-side engagement positions with respect to the second engagement claws 216.

As shown in FIG. 6, each of the first locks 23 arranged in a position between the sheet-feed tray 31 in the operable position and the frame 21. The first lock 23 includes a locking arm 231 and a coil spring 232.

The locking arm 231 is formed to have a shape similar to an "L" in a top view. A front end portion 231A of the locking arm 231 is rotatably attached to a part of the rail 215, and a rear end portion 231B is swingable in the widthwise direction within a swingable range. Further, a roller 231C is rotatably attached to a widthwise tip end of the rear end portion. When the sheet-feed tray 31 is installed in and removed from the operable position, the roller 231 C being in contact with the sheet-feed tray 31 is rotated. Therefore, friction between the locking arm 231 and the sheet-feed tray 31 is reduced, and the sheet-feed tray 31 can be smoothly installed in and removed from the main body 2 of the laser printer 1.

The coil spring 232 is arranged in a position between the frame 21 and the locking arm 231 to press the rear end portion 231B of the locking arm 231 inwardly against the sheet-feed tray 31.

The sheet-feed tray 31 is formed to have a positioning dent 312 (see FIG. 3), which is inwardly dented in the widthwise direction, in a lower position with respect to the first engagement claw 316 on each outer side of the inner-side lateral wall 31A. The positioning dents 312 are placed in positions to become in contact with the rollers 231C of the first locks 23 when the sheet-feed tray 31 is in the operable position. More specifically, the feeder unit 3 is provided with a restricting member (not shown), which restricts the sheet-feed tray 31 in the operable position from being moved rearward. Therefore, when the first locks 23 are urged against rear parts of curvature in the positioning dents 312, the sheet-feed tray 23 is urged rearward against the restricting member by the first locks 23 and placed in the correct operable position. In other words, the first locks 23, which apply expanding force to separate the sheet-feed tray 31 and the frames 21 apart from each other to the sheet-feed tray 31, places the sheet-feed tray 31 in the correct operable position.

Further, with a set of the first lock 23, the first engagement claw 316, and the second engagement claw 216 being arranged in a coincident position at least partially with reference to the direction of depth (i.e., the direction of installation and removal of the sheet-feed tray 31), the first engagement claws 316 and the second engagement claws 216 arranged in vicinities of the first locks 23 can effectively absorb the expanding force from the first locks 23 and restrict the frames 21 from being separated apart from each other whilst the first locks 23 tend to separate the frames 21 apart from each other.

It may be noted in the present embodiment that, within a set of the first engagement claw 316, the second engagement claw 216, and the first lock 23, the first engagement claw 316 and the second engagement claw 216 may not necessarily be in the coincident position with the first lock 23. For example, one of the first engagement claw 316 and the second engagement claw 216 may be partially in the coincident position with the first lock 23, and the other of the first engagement claw 316 and the second engagement claw 216 may be in a different position.

Further, the first lock 23, the first engagement claw 316, and the second engagement claw 216 may not necessarily be arranged in the rear positions with reference to the direction of depth. For example, the first lock 23 may be arranged in the rear position, and the first and second engagement claws 316, 216 may be arranged in positions closer to the front.

Furthermore, a quantity of set of the first engagement claw 316 and the second engagement claw 216 may not necessarily be one. That is, a plurality of sets of the first engagement claw 316 and the second engagement claw 216 may be provided with respect to one first lock 23. For example, two sets of the first engagement claw 316 and the second engagement claw 216, one in an upper position and the other in a lower position with respect to the first lock 23, may be provided on each widthwise side. In this configuration, four sets of the first engagement claw 316 and the second engagement claw 216 are provided in total. Thus, the frames 21 can be restricted from being separated apart from each other even more securely.

With the above-described configuration, when the sheet-feed tray 31 is in the operable position, the first engagement claws 316 of the sheet-feed tray 31 are engaged with the second engagement claws 216 of the frames 12. Therefore, the frames 21 are restricted from being separated apart from each other without employing a specific purpose-made joint member. Specifically, when the first locks 23 apply the expanding force, which may tend to separate the frames 21 apart from each other, the engagement of the first engagement claws 316 and the second engagement claws 216 effectively restrict the frames 21 from being separated apart.

According to the above-described configuration, a set of the first lock 23, the first engagement claw 316, and the second engagement claw 216 is arranged in the coincident position with reference to the direction of depth. Therefore, the expanding force from the first lock 23 can be absorbed promptly in the first engagement claw 316 and the second engagement claw 216, which are in the vicinity of the first lock 23.

Although an example of carrying out the invention has been described, those skilled in the art will appreciate that there are numerous variations and permutations of the image forming apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, the frames 21 may not necessarily be restricted from being separated apart from each other by the expanding force applied from the first locks 21 of the sheet-feed tray 31 but may be restricted by expanding force applied from other locking mechanisms.

More specifically, an image forming apparatus 1 with a return-conveyer 400 will be described below with reference to FIGS. 7-9. The return-conveyer 400 enables the sheet P with an image formed on one side thereof to be reversed and returned to the image forming unit 4 in order to allow images to be formed on both sides of the sheet P. The return-conveyer 400 includes a discharge roller R, a sheet guide (not shown), and a return-conveying unit 410. The discharge roller R conveys the sheet P having been conveyed thereto backwards, and the sheet guide guides the backward sheet P to the return-conveying unit 410. In this regard, whilst the sheet P is guided, the sheet P is reversed (turned over). The return-conveying unit 410 conveys the sheet P with the image formed on one side thereof in the reversed orientation to the image forming unit 4.

The return-conveying unit 410 includes a plurality of return-conveyer rollers 411, which carry the reversed sheet P toward the image forming unit 4, and a sheet guide (not shown). The return-conveying unit 41 is installable in and removable from the main body 2 through the rear opening 2B. Therefore, the return-conveying unit 410 is movable between an operable inner position (see FIG. 7), in which the return-conveying unit 410 is settled a position between the frames 21, and a removed outer position, which is out of the operable inner position (e.g., FIG. 8).

In a position between the return-conveying unit 410 settled in the operable inner position and the frame 21, a second lock 500 to place the return-conveying unit 410 in the correct operable inner position is provided on each widthwise side of the return-conveying unit 410. The second lock 500 applies expanding force, which tends to separate return-conveying unit 410 apart from the frame 21, to the return-conveying unit 410. The second locks 500 are arranged inside rails 218, which are formed on inner surfaces of the frames 21 and allow the return-conveying unit 410 to slidably move along the direction of depth. Each of the second locks 500 includes a locking arm 231 and a coil spring 232, which are similar to those in the aforementioned first lock 23. Further, the return-conveying unit 410 is formed to have positioning dents 412, which are similar to the aforementioned positioning dents 312 in the sheet-feed tray 31.

The return-conveyer 400 is provided with a restricting member (not shown), which restricts the return-conveying unit 410 in the operable inner position from being moved rearward. Therefore, when the second locks 500 are urged against rear parts of curvature in the positioning dents 412, the return-conveying unit 410 is urged rearward against the restricting member by the second locks 500 and placed in the correct operable inner position. In other words, the second locks 500, which apply expanding force to the return-conveying unit 410 to separate the return-conveying unit 410 and the frames 21 apart from each other, places the return-conveying unit 410 in the correct operable inner position.

In this regard, it is preferable that the second lock 500 is arranged in a position to coincide with at least one of the first engagement claw 316 and the second engagement claw 216. With the second lock 500 in the coincident position, the expanding force from the second lock 500 can be absorbed promptly in one of the first engagement claw 316 and the second engagement claw 216, which is in the vicinity of the second lock 500. Therefore, the frames 21 are effectively restricted from being separated from each other.

According to the present invention, the first joint piece 317 may not necessarily be arranged at the front end of the first engagement claw 316, or the second joint piece 217 may not necessarily be arranged at the rear end of the second engagement claw 216 as long as the space between the first engagement claw 316 and the inner-side lateral wall 31A is exposed toward the installation side, from which the sheet-feed tray 31 is installed, and the space between the second engagement claw 216 and the inner surface 21A is exposed toward the side opposite from the installation side. For example, as shown in FIG. 10, a first joint piece 617 may be arranged at an upper end of a first engagement claw 616, and a second joint piece 717 may be arranged at a lower end of a second engagement claw 716.

For another example, the joint beam 214 may be arranged at lower rear positions of the frames 21, and the first locks 23 may be arranged in front positions. In this configuration, the first engagement claws may be arranged in front sections of the sheet-feed tray 31, and the second engagement claws may be arranged in lower front sections in the frames 21.

Further, the first locks 23 and the second locks 500 may not necessarily be provided on both of the right and left sides, but a single lock may be provided in a position between one of the frames 21 and the sheet-feed tray 31 (or the return-conveying unit 410). In this case, the sheet-feed tray 31 (or the return-conveying unit 410) may be urged against the other of the frames 21 by the single lock to be placed in the correct operable position.

For another example, the sheet-feed tray 31 may not necessarily be removable from the laser printer 1 as long as the sheet-feed tray 31 is movable with respect to the main body 2. That is, once the sheet-feed tray 31 is installed in the operable position, the sheet-feed tray 31 may be fixed to the position, for example, via screws and by use of a tool (e.g., a screw driver).

The sheet P may not necessarily be paper (e.g., cardboard, postcard, and thinner paper) but may be, for example, an OHP film sheet.

For another example, the scanner unit 5 in the image forming unit 4 may be replaced with an LED head. Further, the photosensitive drum 81 in the image forming unit 4 may be replaced with a photosensitive belt. Further, the heat roller 71 may be replaced with a cylindrically-rolled fixing film, which is slidably supported in the fixing unit 7. Furthermore, the transfer roller TR may be replaced with, for example, conductive brushes or conductive blade springs, as long as the photosensitive drum 81 is capable of bearing the applied transfer bias from the conductive brushes, blade springs, etc.

For another example, the frames 21 to hold the image forming unit 4 may not necessarily be arranged on the widthwise sides of the main body 2 but may be arranged on the front and rear sides when the sheet-feed tray 31 is movable in the laser printer 1 along the direction of width.

The embodiments described above may not necessarily be applied to a laser printer, but may be employed in, for example, a copier and a multifunction peripheral device.

Further, the frames 21 may be restricted from being separated apart from each other by other removable unit, which is installable in and removable from the laser printer 1, as long as the removable unit is provided with first engagement claws to be engaged with second engagement claws, which are formed in the frames 21.

What is claimed is:

1. An image forming apparatus, comprising:

an image forming unit, which is configured to form an image on a recording sheet having a width and a length;

a pair of frames, which are arranged to face each other and hold the image forming unit interposed in there-between; and a sheet cassette, which is configured to store the recording sheet therein and to be movable between an operable position, in which the sheet cassette is settled in between the pair of frames, and a removed position, which is out of the operable position, wherein the sheet cassette is formed to have a pair of lateral walls on widthwise sides of the sheet cassette along a direction of width of the recording sheet, a first engagement portion, which is arranged on a widthwise outer side of one of the lateral walls with clearance being maintained from an outer surface of the one of the lateral walls, and a first joint portion, which connects the first engagement portion and the one of the lateral walls;

wherein space enclosed by the first engagement portion, the first joint portion, and the outer surface of the one of the lateral walls is exposed toward an installation side, from which the sheet cassette is installed in the image forming apparatus;

wherein the pair of frames is formed to have a second engagement portion, which is arranged on an inner surface of one of the frames along the direction of width of the recording sheet, and a second joint portion, which connects the second engagement portion and the inner surface of the one of the frames;

wherein space enclosed by the second engagement portion, the second joint portion, and the inner surface of the one of the frames is exposed toward a side opposite from the installation side; and wherein, when the sheet cassette is in the operable position, the first engagement portion is placed in an engagement position on widthwise outer side with respect to the second engagement portion to be engaged with the second engagement portion.

2. The image forming apparatus according to claim 1, further comprising:

a first locking member, which is configured to place the sheet cassette in the operable position and to apply expanding force tending to separate the one of the frames apart from the sheet cassette, in a position between the one of the frames and the sheet cassette.

3. The image forming apparatus according to claim 2, wherein the first locking member is arranged in a coincident position with at least one of the first engagement portion and the second engaging portion with reference to a direction of movement of the sheet cassette.

4. The image forming apparatus according to claim 1, further comprising:

a return-conveying unit, which is configured to convey the recording sheet with the image formed on one side thereof to return to the image forming unit in a reversed orientation, wherein the return-conveying unit is movable between an operable inner position, in which the return-conveying unit is settled in between the pair of frames, and a removed outer position, which is out of the operable inner position; and wherein a second locking member, which is configured to place the return-conveying unit in the operable inner position and to apply expanding force tending to separate the one of the frames apart from the return-conveying unit, is provided in a position between the one of the frames and the return-conveying unit.

* * * * *